United States Patent [19]

Kobashi et al.

[11] Patent Number: 4,535,027

[45] Date of Patent: Aug. 13, 1985

[54] HIGH STRENGTH POLYACRYLONITRILE FIBER AND METHOD OF PRODUCING THE SAME

[75] Inventors: Toshiyuki Kobashi; Seiji Takao, both of Okayama, Japan

[73] Assignee: Japan Exlan Company Limited, Osaka, Japan

[21] Appl. No.: 593,239

[22] Filed: Mar. 26, 1984

[30] Foreign Application Priority Data

Apr. 20, 1983 [JP] Japan ..... 58-70449

[51] Int. Cl.[3] ..... D02G 3/00

[52] U.S. Cl. ..... 428/364; 423/447.1; 428/367; 264/210.7

[58] Field of Search ..... 428/364, 367; 423/447.6, 447.1, 447.2; 264/29.2, 210.7

[56] References Cited

U.S. PATENT DOCUMENTS

| | | | |
|---|---|---|---|
| 3,855,382 | 12/1974 | Takeya et al. | 264/210.7 X |
| 4,140,844 | 2/1979 | Lohwasser | 428/364 X |
| 4,421,708 | 12/1983 | Reichardt | 264/206 |
| 4,446,206 | 5/1984 | Fester et al. | 428/364 |

*Primary Examiner*—Lorraine T. Kendell

*Attorney, Agent, or Firm*—Wenderoth, Lind & Ponack

[57] ABSTRACT

Polyacrylonitrile (PAN) fiber of high strength (tensile strength≧20 g/d) produced from a polymer composed mainly of acrylonitrile (AN) and having a weight average molecular weight not less than 400,000, and a method of producing said fiber characterized by a multistage stretching step and a drying step under particular conditions.

1 Claim, No Drawings

HIGH STRENGTH POLYACRYLONITRILE FIBER AND METHOD OF PRODUCING THE SAME

BACKGROUND OF THE INVENTION (a) Field of the Invention

The present invention relates to high strength PAN fiber composed of a high molecular weight AN polymer and a method of producing the same.

(b) Description of the Prior Art

PAN fiber, one of the "three big fibers" and ranking with nylon and polyester fibers, is widely used in the field of wearing apparel which makes the most of its characteristics such as clearness of dyed color, bulkiness, etc. The strength of PAN fiber for use in such wearing apparel is in the order of 3 to 4 g/d.

Carbon fiber produced by carbonizing PAN fiber is used as a reinforcing fiber for composite materials because of its excellent physical properties (high strength, high modulus of elasticity). Since the surface condition, cross-sectional shape, physical properties, etc. of the carbon fiber are determined for the most part by the characteristics of the starting material PAN fiber (precursor), its improvements are contemplated actively. However, the strength of the precursor produced on an industrial scale is generally limited to about 5 to 8 g/d.

On the other hand, the aromatic polyamide fibers represented by Kevlar® produced by DuPont, have a strength higher than 20 g/d owing to their stiff molecular structure, and therefore they are establishing a firm position as reinforcing fiber for tire cord and composite material.

In such a situation, appearance of a high strength PAN fiber is expected that can be used as precursor of highly reliable carbon fiber serviceable for astronautics and aeronautics, or that can be used as reinforcing fiber singly. As an attempt in this regard, Japanese Pat. No. 52125/1981 describes that a high strength PAN fiber can be produced by a special technique which comprises solution-polymerizing AN in a concentrated solution of a complex salt ($NaZnCl_3$), under the action of ultra violet rays, in the presence of formaldehyde and hydrogen peroxide; spinning the thus-obtained solution directly into a coagulation bath; and stretching the resulting fibers at the time of coagulation, thereby to form an oriented tissue in the skin portion. However, even by this method, a strength of 16 g/d is attained at the highest.

SUMMARY OF THE INVENTION

Under such circumstances we conducted research for providing a novel high strength PAN fiber which by far exceeds the conventional level. As a result, it has been found that it is possible to produce a PAN fiber having a tensile strength higher than 20 g by integrally combining technical means which comprises using an AN polymer having a special molecular weight, preparing a spinning solution under particular conditions, spinning the solution, coagulating the resulting filaments, subjecting the coagulated filaments to multistage stretching and then drying the filaments. The present invention has been achieved by this discovery.

An object of the present invention is to provide a high strength PAN fiber having a strength not less than 20 g/d which greatly exceeds the level of the conventional technique, and to provide an industrially advantageous method of producing the same. Another object of the invention is to provide a high strength PAN fiber which can exhibit a remarkable effect in industrial use such as reinforcing fiber for tire cord, resin, etc. and precursor for use in carbon fiber. Other objects of the invention will become apparent from the following detailed explanation.

The PAN fiber that can attain such objects of the present invention is a fiber having a tensile strength not less than 20 g/d produced from a polymer mainly composed of AN and having a weight average molecular weight not less than 400,000. Such a PAN fiber can be produced in an industrially advantageous manner by dissolvoing a polymer composed mainly of AN and having a weight average molecular weight not less than 400,000 in a solvent for said polymer while defoaming the solution under reduced pressure; spinning the thus-obtained spinning solution; coagulating it into filaments; subjecting the filaments to multistage stretching under temperature conditions such that the later the stretching stage the higher the temperature; and then drying the filaments at a temperature lower than 130° C. under tension.

DETAILED DESCRIPTION OF THE PREFERRED EMBODIMENT

In the production of the PAN fiber having a tensile strength not less than 20 g/d, the object of the present invention, the molecular weight of the polymer is important. It is necessary to use a polymer having a weight average molecular weight not less than 400,000, preferably not less than 800,000. As detailed in Journal of Polymer Science (A-1) Vol. 6, pp 147–159 (1968), said molecular weight is obtained by measuring the intrinsic viscosity, [η], of the polymer in dimethylformamide (DMF) and calculated by the following formula:

$$[\eta]=3.35\times10^{-4}M_w^{0.72}$$

wherein $M_w$ represents weight average molecular weight.

To produce such a high molecular weight polymer, any method can be used without limitation as long as the polymer has a molecular weight of not less than 400,000. However the polymer can be produced advantageously on an industrial scale by suspension polymerization of the monomer in an aqueous medium containing a water-soluble polymer, in the presence of an oil-soluble initiator, while maintaining an unreacted monomer concentration higher than 9 weight % in the reaction system. As the monomer is used AN alone or a monomer, there mixture composed of more than 85 weight % AN, preferably more than 95 weight % AN and a known comonomer copolymerizable with AN.

The production of a high strength fiber depends on to what extent it is possible to bring all the molecular chains forming the fiber near to the state of the chains extended in the fiber direction to their full length. For the attainment of such a state, it is important to produce a polymer solution (spinning solution) in which the polymer chains are sufficiently disentangled so that the molecular chains can be easily arranged in parallel and oriented in the fiber direction in the steps of spinning and stretching. As examples of the solvents for producing such a polymer solution, there may be mentioned organic solvents such as DMF, dimethylacetamide, dimethyl sulfoxide, etc. and inorganic solvents such as thiocyanates, zinc chloride, nitric acid, etc. In the wet spinning process, inorganic solvents are superior because they give coagulated gel fibers of better uniformity. Among others, thiocyanates are preferred. It is necessary that the polymer concentration should be fixed generally low, because the viscosity of the spinning solution tends to be high owing to the high molecular weight of the polymer. In addition, the concentration depends on the kind of the solvent, molecular weight of the polymer, etc. Therefore, it is difficult to fix it definitely. However, it is desirable to fix it within the range of from 5 to 15 weight %. The dissolution temperature of the polymer is desirably 70° to 130° C. and the viscosity of the polymer at 30° C. is desirably within the range of from 500,000 to 10,000,000 c.p. Since the viscosity of the high molecular weight polymer is high, defoaming becomes extremely difficult once it contains air bubbles. Also, the air bubbles contained in the spinning solution not only lower the parralel arrangement and orientation of the molecular chains but also they themselves form a great defect and a cause of an extreme drop of the strength of the fiber finally obtained. Therefore it is necessary to dissolve the polymer while defoaming the solution under reduced pressure.

As for the spinning method, any of dry-spinning, wet-spinning and dry/wet spinning may be employed. However, because the viscosity is higher in comparison with the usual spinning solution, dry/wet spinning, in which the spinning solution is extruded in air through a spinnerette and thereafter immersed in a coagulation solution, is preferable in respect of spinnability.

In order that the fiber can withstand the severe stretching in the succeeding steps, it is desirable to produce uniform, coagulated gel filaments. Therefore, it is important to establish a coagulation condition under which slow coagulation takes place. Especially recommended spinning method is the use of an inorganic solvent together with a low temperature coagulation below room temperature. When an organic solvent is used, it is preferable to use multistage coagulation in which the filaments are caused to pass successively through coagulation baths containing a non-solvent (precipitating agent) with gradually increased concentrations. The diameter of the coagulated filaments also has an influence on the uniformity of the gel filaments. The finer the better so far as filament breakage does not take place, and in general it is desirable to control the diameter to within the range of from 50 to 300 $\mu$.

In the following, an explanation will be given on stretching, which is the most important step in revealing the latent high strength fiber properties which have been given in the previous steps such as polymer solution preparation, spinning coagulation, etc.

For such a stretching means, it is necessary to conduct multistage stretching under the temperature condition that the later the stretching stage the higher the temperature. An example of preferred embodiment of such multistage stretching is to carry out stretching operations in succession comprising stretching gel filaments containing residual solvent (the so-called plastic stretching), stretching in hot water, once drying as required, and stretching in steam or in a high boiling point medium having a boiling point higher than 100° C. Also, multistage stretching in the same medium at different temperatures is effective in the improvement of stretchability.

Since the stretching in steam generally tends to form voids in the filaments, it is preferable to carry out stretching in a high boiling point medium having a boiling point higher than 100° C., at a temperature from 100° to 180° C., preferably from 120° to 170° C. As such high boiling point mediums, water-soluble polyhydric alcohols are preferable, and examples of such alcohols are ethylene glycol, diethylene glycol, triethylene glycol, glycerin, 3-methylpentane-1,3,5-triol, etc. Among others, ethylene glycol and glycerin are especially recommended. When the stretching temperature exceeds the upper limit of abovementioned range, the filaments will be broken by fusion, so that such a stretching temperature must be avoided.

Dry heat stretching in the temperature range of from 150° to 230° C. may be employed, but is not an advantageous means in respect of stretchability.

When the stretching operation in a high boiling point medium is employed, the filaments are dried after water-washing, and when said stretching operation is not employed the filaments are dried without treatment. When a polyhydric alcohol remains in the finally obtained filaments, it acts as a plasticizer and lowers the strength. Therefore, the filaments must be washed to an alcohol content less than 5 weight %.

The drying operation must be conducted under tension (limited shrinkage, preferably constant length) because when heat relaxation occurs the strength will be lowered. Even under tension, too high a temperature causes a decrease in strength, so that it is necessary to carry out drying at a temperature lower than 130° C., preferably lower than 120° C.

Thus by integrally combining the technical means recommended in the present invention, it has become possible to obtain a PAN fiber, of which the polymer molecular chains are arranged in parrallel and highly oriented, and which has a strength level greatly improved over the conventional one, that is, a tensile strength not less than 20 g/d.

Such a high strength PAN fiber can be widely used as reinforcing fiber for tire cord and fiber-reinforced composite material, and a precursor for producing carbon fiber.

For a better understanding of the present invention, an example is shown in the following. However, the present invention is not limited in scope by the description of the example. In the example, percentages are by weight unless otherwise indicated.

EXAMPLE

Aqueous suspension polymerization of AN was conducted using 2,2'-azobis-(2,4-dimethylvaleronitrile) as the oil-soluble initiator. As the dispersion stabilizer, a partially saponified (the degree of saponification: 87%) polyvinyl alcohol having a degree of polymerization of 2000 was used. By varying the quantity of the initiator, four kinds of polymers (a–d) having various molecular weights shown in Table 1 were produced.

Each of the polymers thus obtained was washed with warm water at 50° C., and after drying and pulverization, it was dissolved in an aqueous 50% solution of sodium thiocyanate, while at the same time the solution was defoamed under reduced pressure. Thus four kinds of spinning solutions were produced.

After filtration, each of the spinning solutions was subjected to wet/dry spinning through a spinnerette having 0.15 mm$\phi$ orifices, with the distance between the coagulation bath surface and the spinnerette surface being maintained at 5 mm. The temperature of the spinning solution at the time of extrusion was kept at 80° C., and the coagulation bath was regulated to a sodium thiocyanate concentration of 15% and a temperature of 5° C.

The gel filaments which came out of the coagulation bath were stretched twice in length while washed with deionized water. The filaments which left the washing step were then stretched twice in hot water of 85° C., 2.5 times in boiling water and subjected to 2-stage stretching in ethylene glycol (EG). The first EG bath was maintained at 130° C. and the second bath at 160° C. The stretching ratio in each bath was varied as shown in Table 1.

The filaments which came out of the second EG bath were washed with warm water of 60° C. until the residual EG content in the filaments reached an amount less than 0.5 weight %, and were dried at 100° C. under tension. Thus four kinds of fibers (A–D) were produced. Fiber (E) was produced in the same way as Fiber (B) except that the drying temperature was 140° C.

The thus-obtained five kinds of fibers were measured for the tensile strength. The results are shown in Table 1. The tensile strength is a value measured by the constant speed elongation tester (UTM-II-type Tensilon) of the tensile testing method of fibers according to JIS L 1069, with a grip gap of 20 mm and an elongation speed of 100%/min.

TABLE 1

| | | Specimen of the present invention | | Specimen for comparison | | |
|---|---|---|---|---|---|---|
| Fiber name | | A | B | C | D | E |
| Spinning solution | Polymer name | a | b | c | d | e |
| | Polymer molecular weight | 2280,000 | 450,000 | 320,000 | 120,000 | 450,000 |
| | Polymer concentration (%) | 5 | 11 | 15 | 24 | 11 |
| Stretching ratio EG | First bath | 1.8 | 1.8 | 2.0 | 2.0 | 1.8 |
| | Second bath | 1.6 | 2.0 | 3.0 | 4.0 | 2.0 |
| Total stretching ratio | | 28.8 | 36.0 | 60.0 | 80.0 | 36.0 |
| Tensile strength (g/d) | | 25.1 | 20.5 | 15.5 | 8.6 | 15.3 |

From the above Table, it is understood that, when a polymer of AN having a molecular weight less than 400,000 is employed, a PAN fiber having a sufficient strength cannot be obtained even by employing the spinning and after-treating methods recommended in the present invention, and also in the case of the fiber of which the drying temperature is outside of the upper limit of the range of the present invention (Fiber E), a high strength cannot be obtained, whereas the fibers of the present invention have excellent strength.

What is claimed is:

1. A polyacrylonitrile fiber having a tensile strength not less than 20 g/d, and produced from a polymer composed mainly of acrylonitrile and having a weight average molecular weight not less than 400,000.

* * * * *